US009321060B2

(12) United States Patent
Pahl et al.

(10) Patent No.: US 9,321,060 B2
(45) Date of Patent: Apr. 26, 2016

(54) WIDE PATTERN NOZZLE

(75) Inventors: Andreas Pahl, Erkrath (DE); Edward Bolyard, Old Hickory, TN (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 13/387,498

(22) PCT Filed: Jul. 27, 2010

(86) PCT No.: PCT/US2010/043321

§ 371 (c)(1),
(2), (4) Date: Jan. 27, 2012

(87) PCT Pub. No.: WO2011/014480

PCT Pub. Date: Feb. 3, 2011

(65) Prior Publication Data

US 2012/0121803 A1 May 17, 2012

(30) Foreign Application Priority Data

Jul. 29, 2009 (DE) ..... 10 2009 035152

(51) Int. Cl.

| | |
|---|---|
| ***B05C 5/00*** | (2006.01) |
| ***B05B 1/20*** | (2006.01) |
| ***B05C 5/02*** | (2006.01) |
| *B05B 7/08* | (2006.01) |

(52) U.S. Cl.

CPC ..... *B05B 1/205* (2013.01); *B05C 5/0275* (2013.01); *B05B 7/0884* (2013.01)

(58) Field of Classification Search

CPC ..... B05B 1/205; B05B 7/0884; B05C 5/0275

USPC ..... 427/207.1, 208.2, 208.4, 208.6; 239/11, 239/124, 135, 292, 296, 596

See application file for complete search history.

(56) References Cited

U.S. PATENT DOCUMENTS

| | | | | |
|---|---|---|---|---|
| 5,124,111 | A * | 6/1992 | Keller et al. | 264/555 |
| 5,882,573 | A | 3/1999 | Kwok et al. | |
| 5,904,298 | A | 5/1999 | Kwok et al. | |
| 6,074,597 | A | 6/2000 | Kwok | |
| 6,197,406 | B1 | 3/2001 | Kwok | |
| 6,422,848 | B1 * | 7/2002 | Allen et al. | 425/7 |

(Continued)

FOREIGN PATENT DOCUMENTS

| | | | |
|---|---|---|---|
| DE | 69809521 | T3 | 2/2008 |
| EP | 0835952 | A1 | 4/1998 |

(Continued)

OTHER PUBLICATIONS

Search Results for DE 10 2009 035 152.3 dated Feb. 1, 2010.
ISR for PCT/US2010/43321 dated Nov. 2, 2010.

*Primary Examiner* — Xiao Zhao
(74) *Attorney, Agent, or Firm* — Hauptman Ham, LLP

(57) ABSTRACT

The invention relates, inter alia, to a device for applying a plurality of threads of a fluid, such as adhesive or lotion, to a moving web-like substrate, having a plurality of outlet openings for the threads of fluid, wherein each outlet opening is disposed between a pair of flow openings, through which a flow fluid, in particular compressed air, flows in order to achieve thread oscillation. The special feature consists, inter alia, in that the outlet openings are disposed along a curved path.

17 Claims, 5 Drawing Sheets

(56) References Cited

U.S. PATENT DOCUMENTS

Figure 1:
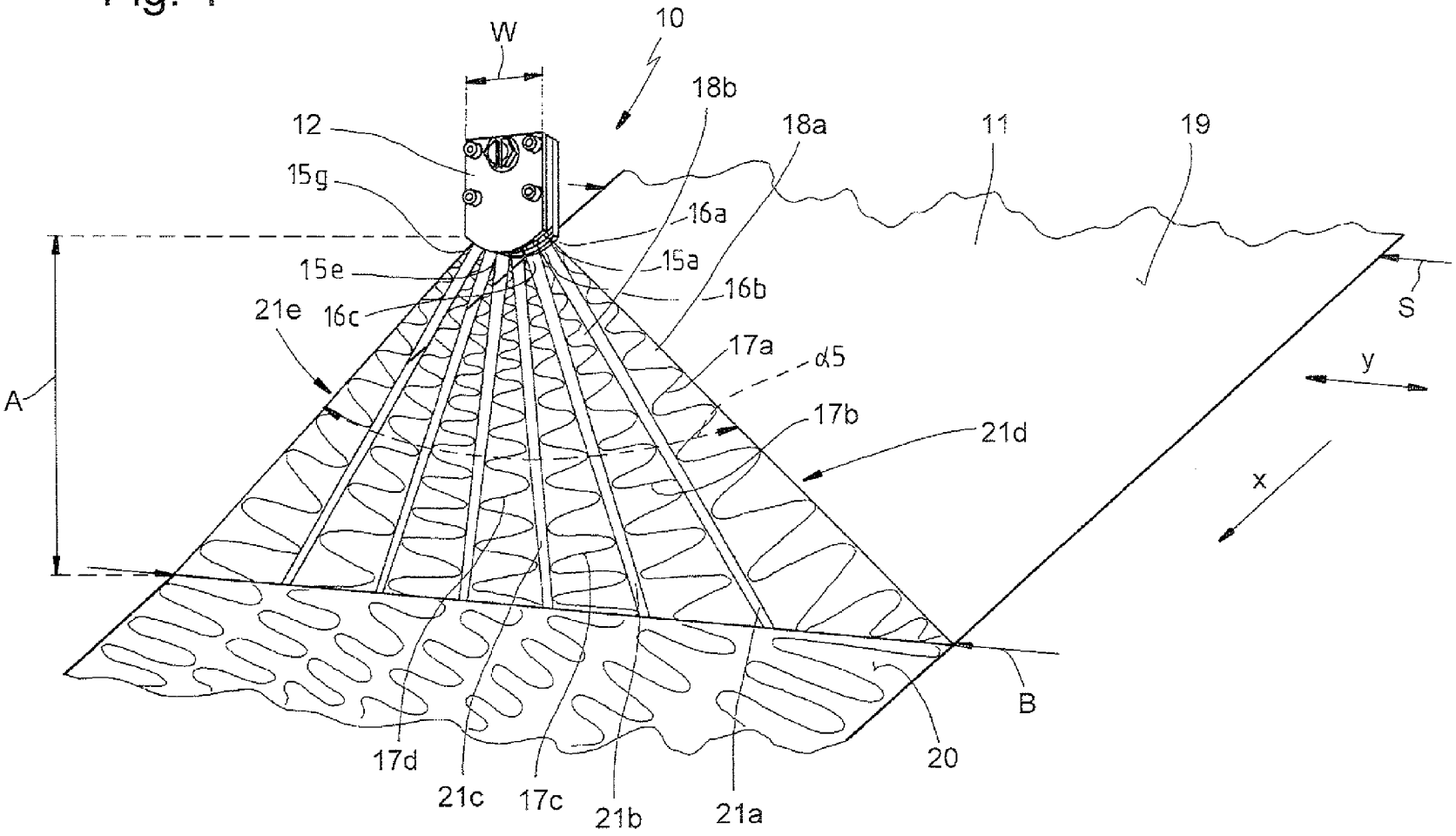

| | | | |
|---|---|---|---|
| 6,461,430 | B1 | 10/2002 | Kwok |
| 6,602,554 | B1 | 8/2003 | Kwok |
| 6,719,846 | B2 | 4/2004 | Nakamura et al. |
| 6,890,167 | B1 | 5/2005 | Kwok et al. |
| 2002/0083895 | A1 | 7/2002 | Nakamura et al. |

FOREIGN PATENT DOCUMENTS

| | | | |
|---|---|---|---|
| EP | 0904849 | A2 | 3/1999 |
| EP | 0984083 | A2 | 3/2000 |
| EP | 1116521 | A2 | 7/2001 |
| JP | H0737797 | A | 2/1995 |
| JP | 2004154665 | A | 6/2004 |

* cited by examiner

WIDE PATTERN NOZZLE

RELATED APPLICATIONS

The present application is national phase of PCT/US2010/043321 filed Jul. 27, 2010, and claims priority from German Application Number 10 2009 035 152.3 filed Jul. 29, 2009.

The invention relates to a device according to the preamble of claim 1.

Devices of this type have been developed and fabricated by the applicant for some time. A device according to the preamble of claim 1 is described, for example, in EP 0 835 952 A1 and in EP 0 984 083 A2, which both go back to the applicant.

In the known devices, threads of fluid are caused to oscillate by means of lateral air flows. As a result, the application pattern on the substrate can be evened out to a great extent.

In the previously known devices, the outlet openings are disposed along a straight line, transversely with respect to the direction of movement of the substrate. A plurality of nozzles or nozzle heads can be combined to form a linear row arrangement of any desired length. In this way, the application width along which the threads of fluid are to be applied to the substrate can be varied and adjusted. As a rule, the application width corresponds to the distance of the two outermost outlet openings from each other. The outlet width can also be enlarged to a multiple of this length by a plurality of nozzle heads—of identical width—being disposed beside one another.

In the devices from the prior art, outlet openings for the fluid and flow openings for the compressed air alternate. It is also known to dispose two flow openings between two fluid outlet openings in each case.

Starting from the known device, the object of the invention is to develop a device according to the preamble of claim 1 further in such a way that it makes flexible processing of a substrate possible.

The invention achieves this object with the features of claim 1 and, accordingly, is characterized in that the outlet openings are disposed along a curved path.

The principle of the invention is that the outlet openings for the threads of fluid are no longer disposed along a straight line, as in the prior art, but are now disposed along a curved path. The curved path can be formed, for example, by a circular arc or an ellipse or a parabola. Other curved paths with a regular or irregular curvature are also suitable. The path along which the outlet openings are disposed can run continuously and be curved continuously.

Through the choice of this special arrangement, the result is a geometry such that the outlet openings are in each case aimed at the substrate surface at different angles.

The device can advantageously be constructed symmetrically. The outlet opening coming closest to the substrate surface can be aimed orthogonally at the substrate surface. On this basis, in each case adjacent outlet openings can be aimed at the substrate surface with an increasing angular deviation from the right angle.

Consequently, the invention provides for the outermost outlet openings to be aligned at the largest possible angle of deviation with respect to the orthogonal. For example, the two outer outlet openings can be aligned in such a way that they enclose an angle of 70° between themselves. In other words, the respectively outer outlet opening is aimed at the substrate surface at such an angle that a deviation of about 35° from said orthogonal is provided. The outer outlet openings are then inclined at an angle of 90°−35°=55° relative to the substrate surface.

The invention covers devices with which adhesives, in particular hotmelt adhesives or other glues, can be applied. An application can be made, for example, to cardboard packaging, papers, textiles or any other desired materials. The invention also covers devices with which a lotion is applied for example to a hygiene product, such as a diaper.

The invention covers devices in which outlet openings and flow openings are arranged alternately. In this configuration of the invention, there is exactly one flow opening between two outlet openings in each case.

In an alternative refinement of the invention, there is a pair of flow openings between two outlet openings. Expressed in other words, in this variant each outlet opening is assigned its own pair of flow openings.

The invention also covers those devices in which each outlet opening is assigned more than two flow openings.

The invention covers devices in which outlet and flow openings are disposed along a common curved path. However, the invention also covers devices in which outlet openings, on the one hand, and flow openings, on the other hand, are disposed along different curved paths, for example curved paths arranged offset from one another. The latter can be imagined, for example, when the flow openings are disposed so as to be offset slightly relative to the outlet openings.

In the device according to the invention, it is preferably compressed air that flows through the flow openings, in order to subject the threads of fluid to a thread oscillation or a pendulum-like movement. The thread oscillation is used for a uniform coating or wetting of the substrate surface as a result of which the threads are deposited on the substrate surface in wavy lines, forming a network structure. Instead of compressed air, other flow fluids, such as gases, can also be used.

In an advantageous refinement, the two outer outlet openings enclose between themselves an angle of more than 20°. This means that imaginary geometric lines which run through the outlet opening along the outlet direction of the fluid enclose between themselves a 20° angle or a greater angle. In an advantageous refinement, the angle is more than 30°, in a further advantageous refinement more than 40°, in a further advantageous refinement more than 50°, in a further advantageous refinement more than 60° and in a further advantageous refinement more than 70°. In one exemplary embodiment of the invention, this angle is about 70°.

On the basis of the large angle described, it is possible for an application width of the fluid on the substrate which considerably exceeds the dimensions of the device to become possible. The threads of fluid can originate from a center substantially in the manner of a starburst and coat not only the region of the substrate which is moved along directly underneath the device but also regions of the substrate which, in relation to the direction of movement of the substrate, run laterally beside the device. Therefore, firstly it is possible to implement a device which can be produced beneficially with a compact design and simple construction. Secondly, this device can be employed variably and permits flexible coating of a substrate.

For instance, by changing the distance between substrate and outlet openings, the application width can be varied and adjusted to the desired dimension. By contrast, according to the prior art it was necessary to add or to remove a nozzle module having a plurality of outlet openings in order to change an application width.

In addition, according to the invention it is possible for a plurality of devices to be arranged beside one another or slightly offset—in relation to the direction of movement of the substrate—one after another. It is therefore advantageously possible also to achieve a homogeneous overlap region between two nozzle modules.

According to a particularly advantageous refinement of the invention, two flow openings are disposed on the outside of the respective outer outlet opening. The outermost outlet opening is thus not only flanked by two flow openings, a flow opening on the inside and a flow opening on the outside, but an additional outer flow opening is also provided. This is used to pull slightly upward or outward those threads of fluid which run on the outside and which, to this extent, have to cover the longest distance from the outlet opening as far as the substrate surface, in order in this way to counteract the influence of the force of gravity. This likewise serves to homogenize the application pattern.

According to a further advantageous refinement of the invention, the flow openings have different cross sections. Provision can be made here that, at least in a few flow openings close to the edge, i.e. placed on the outside, the cross section of the flow openings increases toward the edge. In addition, it is possible in this way for the threads of fluid arranged on the outside to have a more intense flow around them, such that detrimental influences of the force of gravity are compensated.

Advantageously, provision can be made for the application width to considerably exceed the distance of the two outer outlet openings from each other. It is therefore possible for the first time to achieve application widths which are far greater than the distance of the outer outlet openings from each other.

Furthermore, the invention relates to a method for applying a plurality of threads of a fluid. Such a method is known from the documents from the applicant described at the beginning.

The invention is based on the object of developing the known method further in such a way that more variable substrate coating becomes possible.

The invention achieves this object with the features of claim 9.

With respect to the advantages and effects of the technical features of the method as claimed in claim 9, the advantages described above in relation to claims 1 to 8 apply in an analogous way and to the same extent, so that reference is made to the passages there in order to avoid repetitions.

Figure 7:
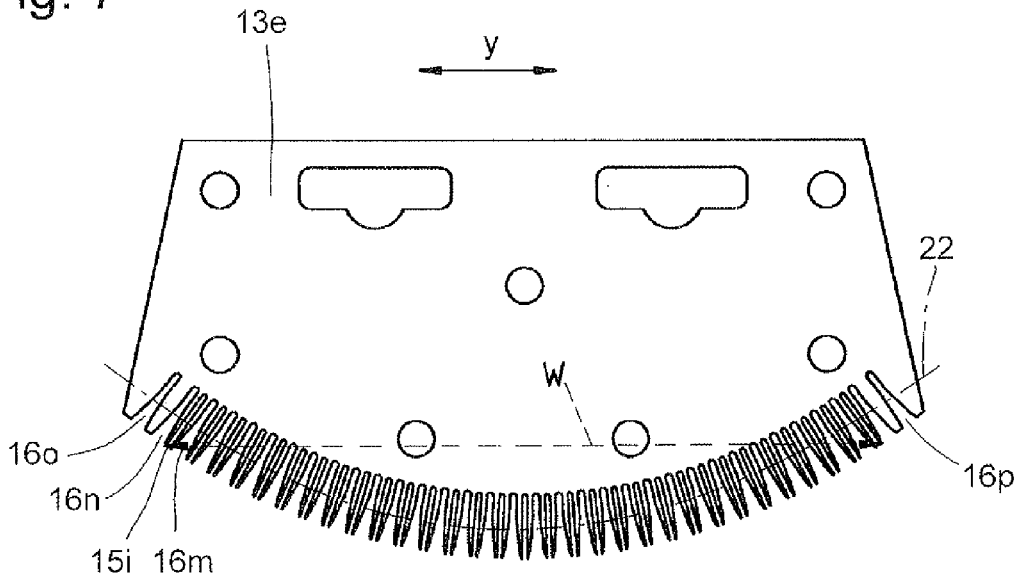
Figure 2:
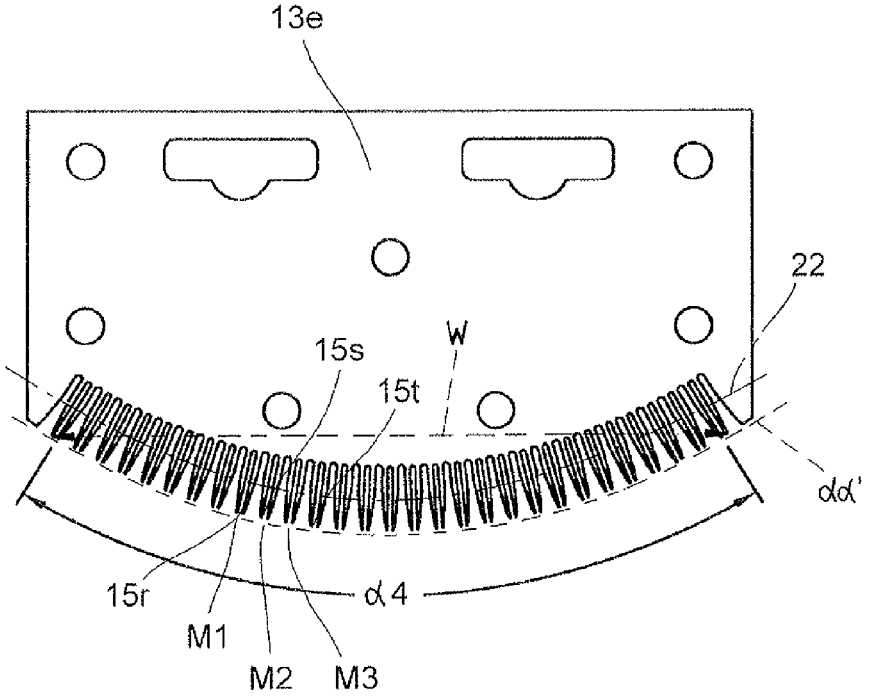
Figure 4A:
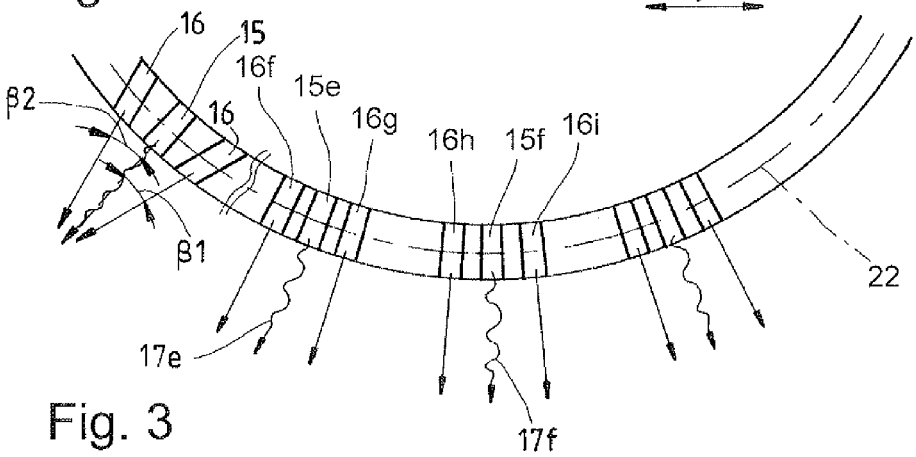
Figure 3:
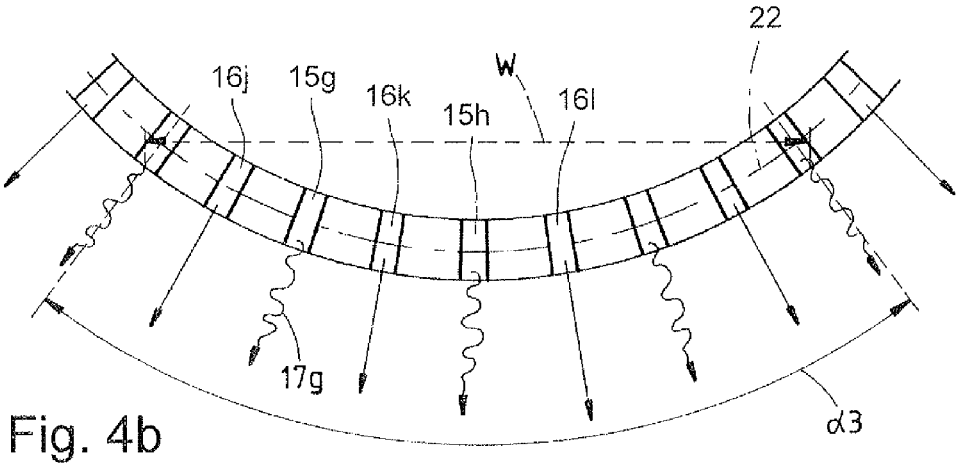
Figure 4B:
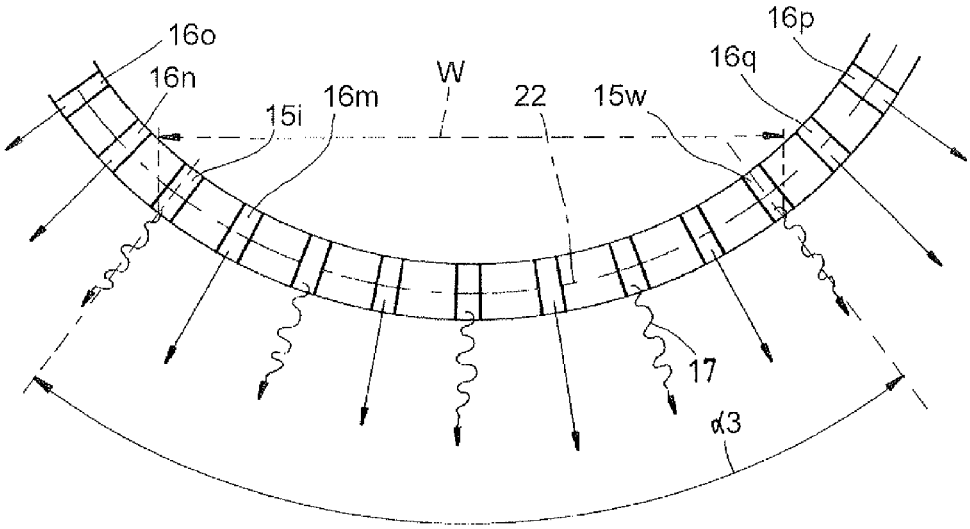
Figure 5:
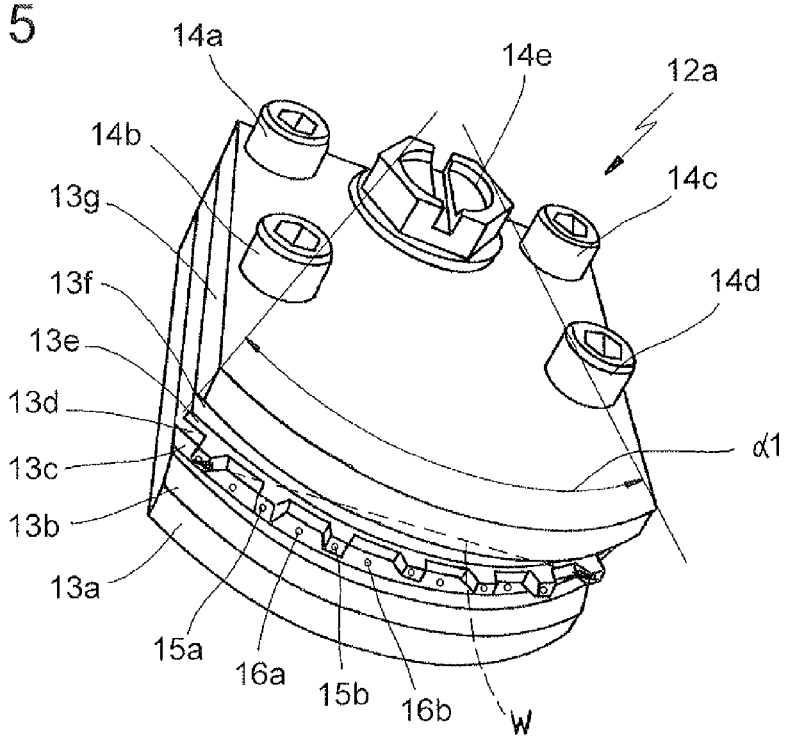
Figure 6:
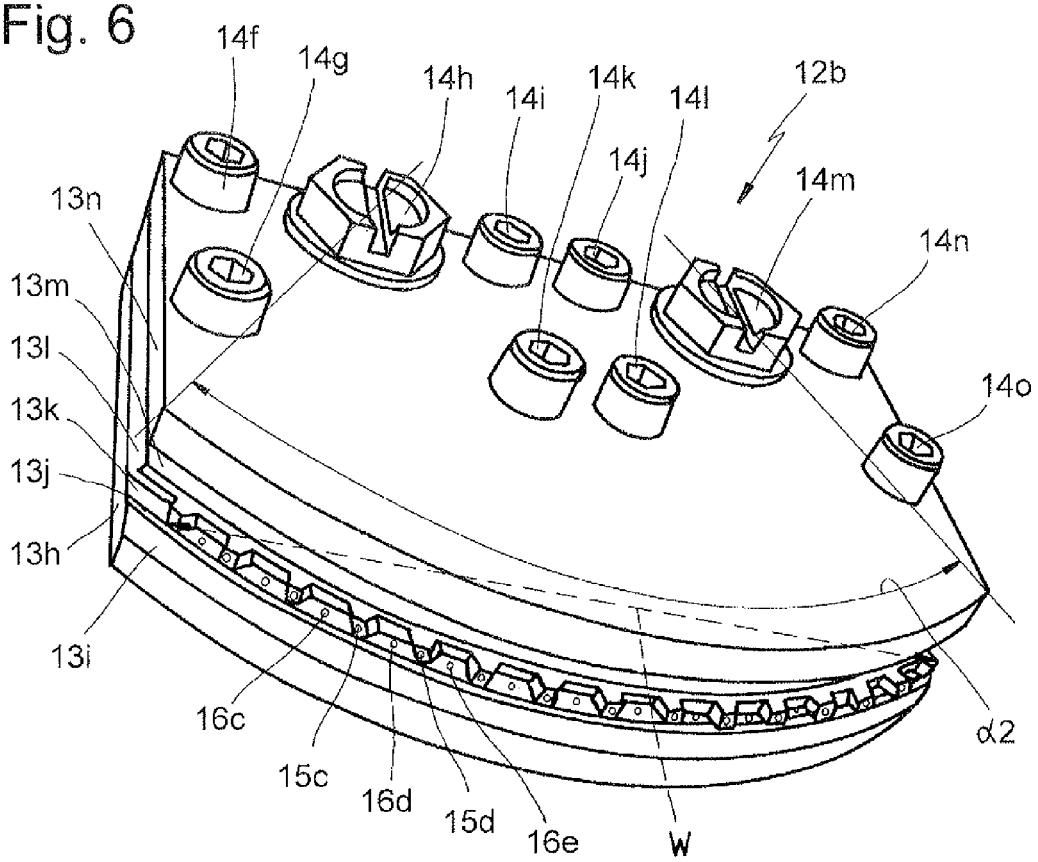
Figure 8:
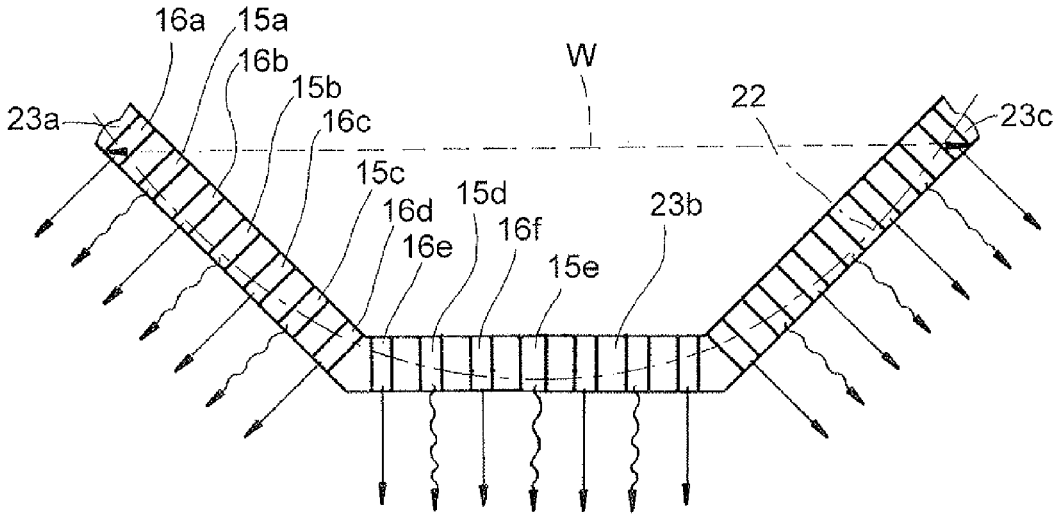
Figure 9:
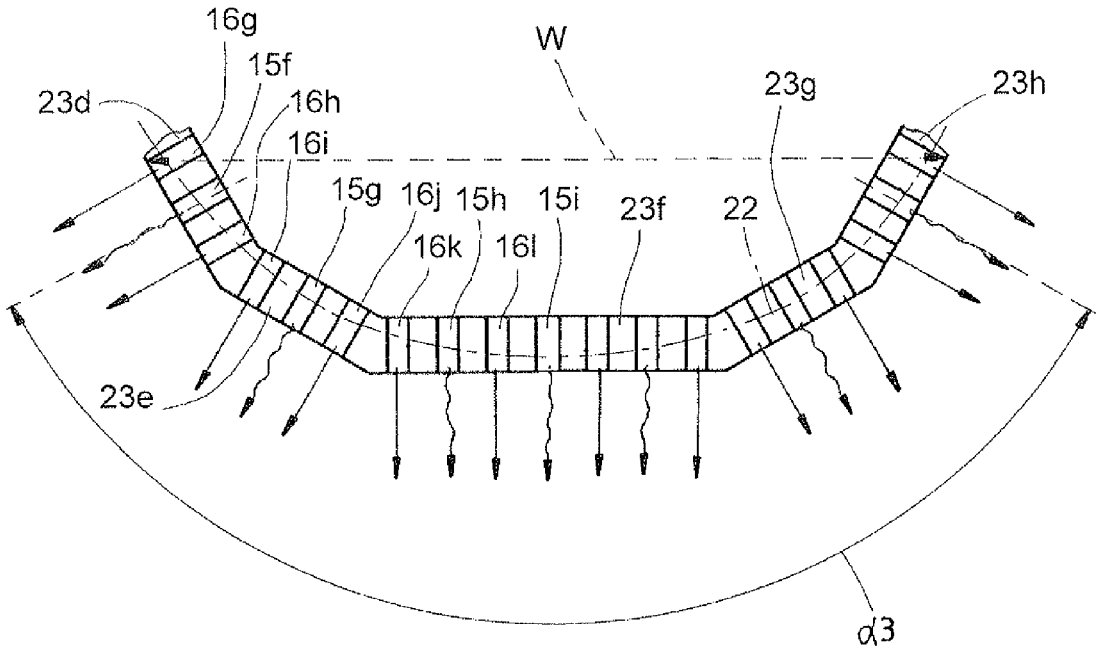

Further advantages of the invention emerge from the subclaims not cited and also from the description which now follows of the exemplary embodiments illustrated in the drawings, in which:

FIG. 1 shows a first exemplary embodiment of a device according to the invention during operation, in a schematic, perspective view, FIG. 2 shows a detail view of a plate-like element as a constituent part of a nozzle module of the device from FIG. 1 to illustrate the arrangement of the outlet openings along a curved path, FIG. 3 shows a schematic illustration of an extract from the plate-like element, FIG. 4*a* shows, in an illustration according to FIG. 3, an exemplary embodiment modified with respect thereto, FIG. 4*b* shows a further exemplary embodiment in an illustration according to FIG. 4*a*, FIG. 5 shows a perspective view of an exemplary embodiment of a nozzle module of the device from FIG. 1 in a detailed illustration, FIG. 6 shows, in an illustration according to FIG. 5, a further exemplary embodiment of a nozzle module according to the invention having a higher number of outlet openings, FIG. 7 shows, in an illustration according to FIG. 2, a further variant of a nozzle plate analogous to the illustration of FIG. 4*b*, FIG. 8 shows a further exemplary embodiment of a nozzle module according to the invention in an illustration similar to that of FIG. 3, and FIG. 9 shows a further exemplary embodiment of a nozzle module according to the invention.

The device according to the invention is designated in its entirety by 10 in the figures. For reasons of clarity, identical or mutually comparable parts or elements, even to the extent that different exemplary embodiments are involved, are designated by the same designations, partly with the addition of small letters.

According to FIG. 1, the device 10 according to the invention is illustrated perspectively and schematically. For reasons of clarity, important parts of the device have been left out.

The device 10 comprises a module 12, which is arranged above a substrate 11. The substrate 11 is in web form and has a substrate width S. The substrate is moved in the direction of movement X by drives, for example rollers, not illustrated. The nozzle module 12 is arranged in a stationary manner.

Not illustrated is the holder for the module 12. Load-bearing rods or similar stand arrangements can be provided for the holder, which advantageously permit the module 12 to be displaced in a direction Y transversely with respect to the direction of movement X, and also permit locking of the selected position of the module 12 relative to the substrate.

In one variant of the invention, provision can also be made in the device 10 according to the invention that a change can be made in the distance A between module 12 and substrate surface 19 or, strictly speaking, between the outlet openings 15 and the substrate surface 19.

The module 12 is supplied with compressed air via a line, not illustrated, and with hotmelt adhesive or with another fluid via a further line, not illustrated.

On account of a specific geometry of the outlet openings, which will be described in more detail later, the adhesive emerges from the nozzle module 12 through a plurality of outlet openings 15 as threads. Each outlet opening 15 is flanked by a flow opening 16, through which compressed air passes. As will be explained further later by using FIG. 3, the outlet openings 15 and the flow openings 16 are disposed along a curved path 22.

If the compressed air is switched on and the adhesive feed is open, then, in the exemplary embodiment of FIG. 1, seven threads of adhesive 17*a*, 17*b*, 17*c*, 17*d*, 17*e*, 17*f*, 17*g* emerge through the seven outlet openings 15. Each thread of adhesive is flanked by two lateral air flows. Because of the air flows, movements, in particular pendulum-like or oscillation-like movements, of the thread 17 occur. As soon as the thread 17 strikes the surface 19 of the substrate 11, this thread is deposited in wavy lines and the result is the coating pattern of the surface 20 illustrated schematically in FIG. 1. Because of the wavy deposition, the threads are able to form an overall very homogeneous network structure on the surface 19 of the substrate 11.

As already emerges from FIG. 1, the outlet pattern of the seven threads of adhesive from the nozzle module 12 is like a starburst overall, so that the result is an adhesive thread curtain which is formed in the manner of a fan.

The two air flow regions assigned respectively to each thread 17 of adhesive form and define residence regions 18*a*, 18*b*, 18*c* and so on for the threads of adhesive. Although this illustration should be understood as only schematic, the technical principle basically applies.

As already emerges from FIG. 1, the two outermost threads of adhesive enclose between themselves an angle $\alpha_5$. This angle is designated $\alpha_1$, $\alpha_2$, $\alpha_3$ or $\alpha_4$ in the other exemplary embodiments; it is also possible for the angle to be chosen differently if different exemplary embodiments are involved.

On the basis of the choice of the relatively large angle between the two outermost threads of adhesive or between the outermost outlet openings 15, starting from a central nozzle module 12, coating is achieved not only of those regions of the surface 19 of the substrate 11 which run directly underneath the module 12, but also regions spaced apart laterally are also covered. The application width B of fluid on the substrate surface 19 which can be achieved according to FIG. 1 considerably exceeds the external dimensioning W of the nozzle module 12.

For reasons of completeness, it should be pointed out at this point that the dimension W, strictly speaking, describes the distance between the two outermost outlet openings 15 for the adhesive.

Depending on the choice of the distance A, the achievable application width B can be more than 1.5 times the distance W, advantageously more than 2 times, further advantageously more than 2.5 times, further advantageously more than 3 times, the distance W.

In order to achieve such a fan-like formation of an adhesive thread curtain, as best emerges from the schematic sketch of FIG. 3, the adhesive outlet openings 15*g*, 15*h* and so on are disposed along a curved path 22. The curved path 22 replaces the straight line known according to the prior art.

The curved form of the path 22 leads to the adhesive outlet openings 15*g*, 15*h* being aimed at the substrate surface 19 at different angles. The fan-like formation of the spray curtain according to FIG. 1 therefore arises.

FIG. 3 is merely intended to illustrate schematically how a nozzle plate 13*e* according to the exemplary embodiment of FIG. 2, and as it is used in a device according to FIG. 1, is constructed with respect to the sequence of outlet openings 15 and flow openings 16. Here, it should be noted that FIG. 3 shows a schematic cross-sectional illustration, whereas FIG. 2 and FIG. 7 merely describe plate-like elements which merely indicate the outlet openings 15 and the flow openings 16.

As indicated by FIGS. 5 and 6, a nozzle arrangement 12 is assembled in the manner of a sandwich from a plurality of plate-like elements.

In the exemplary embodiment of FIG. 3, flow openings 16*j*, 16*k* and 16*l* and fluid outlet openings 15*g*, 15*h* and so on alternate in each case. This means that, in each case between two outlet openings 15*g*, 15*h* there is arranged exactly one flow opening 16*k* and between two flow openings 16*j*, 16*k* there is arranged exactly one fluid outlet opening 15*g*.

However, the invention also covers devices according to FIG. 4*a*, in which each fluid outlet opening 15*g* is flanked by two flow openings 16*f*, 16*g* or by more flow openings and, furthermore, provision being made for two flow openings 16*g*, 16*h* to be disposed between two fluid outlet openings 15*e*, 15*f* in each case.

In the exemplary embodiment of FIG. 4*a*, at the left-hand edge of this figure, it is indicated, merely by way of example, that the flow openings 16 do not necessarily have to run in parallel relative to the outlet opening 15 but, for example, can also be disposed at an acute angle $\beta_1$, $\beta_2$ to the outlet opening 15. In some exemplary embodiments, this can permit an advantageous flow around the adhesive thread 17.

Of course, in some exemplary embodiments of the invention, flow openings 16 and outlet openings 15 oriented exclusively parallel to one another can be provided. In other exemplary embodiments of the invention, there are exclusively flow openings 16 which are not arranged parallel to the respective outlet openings. Finally, there are exemplary embodiments in which flow openings 16 and outlet openings 15 disposed in parallel and also at acute angles to one another are provided.

As is revealed by the two different embodiments of FIGS. 5 and 6, for example, a nozzle module 12 can be assembled in the manner of a sandwich from various plates 13. For instance, the exemplary embodiment of FIG. 5 has a plurality of plates 13*a*, 13*b*, 13*c*, 13*d*, 13*e*, 13*f*, 13*g* which are held together by fixing screws 14*a*, 14*b*, 14*c*, 14*d*, 14*e*. To avoid repetitions, reference should hereby be made to the disclosure content of EP 0 835 952 A1, the content of which is hereby included in the content of the present patent application. The document cited already describes how precise steering of adhesive and compressed air is achieved on the basis of a sandwich structure of different plates.

The plate 13*e*, which is significant for the invention, is shown by FIG. 2. This plate replaces the plate illustrated in FIG. 3*a* of EP 0 835 952 A1, it being clear to those skilled in the art that, in order to achieve a nozzle arrangement 12 according to FIGS. 5 and 6, further plates are provided, which have undergone appropriate modifications.

FIG. 2 shows a plate 13*k* which can be used in the exemplary embodiment of FIG. 6. FIG. 6 corresponds, in terms of the basic principle, to the exemplary embodiment of the nozzle module 12*a* of FIG. 5, the number of outlet openings 15 having been increased in order to achieve a greater application width.

While the exemplary embodiment of FIG. 5 has seven glue outlet openings 15, the exemplary embodiment of FIG. 6 has sixteen glue outlet openings. By contrast, the exemplary embodiment of FIG. 2 shows 29 glue outlet openings.

The number of outlet openings depends on various parameters, such as the speed of the substrate, the desired application pattern, the type of adhesive, the available flow pressure of the compressed air and other factors. In particular, the desired application width also plays a major role.

The exemplary embodiment of FIG. 4*b* also shows a further special feature as compared with the exemplary embodiment of FIG. 3: here, it can be seen that not just one flow opening but two flow openings are disposed outside the respective outermost fluid outlet opening 15*i* and 15*w*. Thus, a first flow opening 16*n* and a second flow opening 16*o* are disposed outside the fluid outlet opening 15*i*, and a first flow opening 16*q* and a second flow opening 16*p* are disposed outside the fluid outlet opening 15*w*. Therefore, a fluid thread 17 at the side edge, i.e. located maximally on the outside, can be drawn upward by an additional flanking applied flow, based on the image of FIG. 1. To this extent, the force of gravity is counteracted. This permits the achievement of a uniform coating of the substrate with adhesive.

In a further refinement of the invention, provision is made for the flow openings 16 to have different cross sections. For instance, provision can advantageously be made in particular for a variation in the opening cross section to be made in some of the flow openings arranged on the outside, in such a way that the cross section of the flow opening increases toward the outside. The force of gravity can also be counteracted in this way and an evened-out coating can be achieved.

It becomes clear to those skilled in the art that the adhesive threads which are arranged at the side edge have to cover the longest path to the substrate and, to this extent, are most intensely subjected to the influences of the force of gravity. Here, with additional flow forces, it is possible for the threads not to be deflected too much on their long path toward the substrate. As a result, this leads to a uniform application of fluid.

The exemplary embodiment of FIG. 7 shows a plate 13*e* which is modified with respect to exemplary embodiment 2 and in which—in a way analogous to the described embodiment of FIG. 4*b*—additional flow openings 16*o* and 16*p* are provided at the side edges.

In the method according to the invention, provision can be made for the distance A between outlet openings 15 and substrate surface 20 to be varied, in order to adjust or to change the application width B.

With respect to FIGS. 3 to 4*b*, it should further be noted that straight arrows describe the course of the flow of the compressed air or of the alternatively suitable flow fluid, whereas the wavy arrows are intended to indicate the emergence of adhesive.

With respect to the figure description overall, it should be noted that this relates only to exemplary embodiments in which adhesive emerges as fluid. Other devices according to the invention, in which lotions or other fluids are used, can be operated in the same way.

From FIGS. 3 to 4*a* and also 2 and 7 it becomes clear that the outlet openings 15 are disposed along a curved path 22 or 22'. Strictly speaking, it is a matter of disposing the opening regions M of the outlet openings 15 along a curved path. In this regard, FIG. 2 shows that opening regions $M_1$, $M_2$, $M_3$ and so on are disposed along the curved path 22'. However, since this curved path 22' corresponds to the curved path 22 or exhibits the same curvature, the arrangement according to the invention of the outlet openings 15*r*, 15*s*, 15*t* can be described both by a curved path 22 and by a curved path 22'.

In addition, reference should now be made to the exemplary embodiments of FIGS. 8 and 9:

FIG. 8 shows an exemplary embodiment of the invention in which a large number of outlet openings 15*a*, 15*b*, 15*c*, 15*d*, 15*e* and flow openings 16*a*, 16*b*, 16*c*, 16*d*, 16*e* are disposed along a curved path 22 in an alternating sequence, comparable with the exemplary embodiment of FIG. 3. The outlet openings 15 and the flow openings 16 are, however, disposed along straight sections 23*a*, 23*b*, 23*c*. Strictly speaking, to this extent this is a polygon. The outlet openings 15 and the flow openings 16 are disposed in this exemplary embodiment in such a way that the arrangement of these openings 15, 16 merely approximates a curved path 22.

In the exemplary embodiment of FIG. 9—in a way similar to that in the illustration of FIG. 8—once more a polygon-like structure of the arrangement of the outlet openings 15 is made. Here, five sections 23*d*, 23*e*, 23*f*, 23*g*, 23*h* running in a straight line are provided, which provide an arrangement of the outlet openings 15 along a curved path 22 once more. These exemplary embodiments are also covered by the teaching according to the invention.

The invention claimed is:

1. A device for applying a plurality of threads of a fluid, such as adhesive or lotion, to a moving web-like substrate, having a plurality of outlet openings for the threads of fluid, wherein each outlet opening is disposed between a pair of flow openings, through which a flow of fluid flows in order to oscillate the threads, thereby applying the fluid on the moving web-like substrate in an oscillatory pattern, wherein the outlet openings are disposed along a curved path, and in that two directly adjacent flow openings are disposed outside at least one outer outlet opening.

2. The device as claimed in claim 1, characterized in that the outlet openings and the flow openings are disposed along a common curved path.

3. The device as claimed in claim 1, characterized in that the device is constructed substantially mirror-symmetrically.

4. The device as claimed in claim 1, characterized in that all the outlet openings have an identical or similar cross section.

5. The device as claimed in claim 1, characterized in that the cross section of the flow openings increases toward the edge.

6. The device as claimed in claim 1, characterized in that the application width exceeds the distance of the two outer outlet openings from each other.

7. The device as claimed in claim 1, wherein the flow openings are disposed along a second curved path that is offset from the curved path of the outlet openings.

8. The device as claimed in claim 1, wherein a pair of flow openings are between adjacent outlet openings.

9. The device as claimed in claim 8, wherein the device includes a pair of flow openings for each outlet opening.

10. The device as claimed in claim 1, wherein the two outer outlet openings enclose between themselves an angle of more than 60°.

11. The device as claimed in claim 1, wherein the two outer outlet openings enclose between themselves an angle of more than 20°.

12. The device as claimed in claim 1, wherein the device oscillates the threads in a plane.

13. The device as claimed in claim 1, wherein the device is configured such that the plurality of threads of the fluid are ejected from the outlet openings such that the threads have a trajectory lying on the same plane.

14. The device as claimed in claim 1, wherein the device is configured such that the threads applied to the moving web-like substrate have a sinusoidal pattern.

15. A device for applying a plurality of threads of a fluid, such as adhesive or lotion, to a moving web-like substrate, having a plurality of outlet openings for the threads of fluid, wherein each outlet opening is disposed between a pair of flow openings, through which a flow fluid, in particular compressed air, flows in order to achieve thread oscillation, characterized in that the outlet openings are disposed along a curved path, and in that the two outer outlet openings enclose between themselves an angle of more than 30°, wherein relative to the curve path, outermost outlet openings are flanked by a flow opening on an inside and a flow opening on an outside, and at least one additional outer flow opening is located on an outside of at least one outside flanking flow opening.

16. The device as claimed in claim 15, wherein the flow openings are disposed along a second curved path that is different from the curved path of the outlet openings.

17. The device as claimed in claim 15, wherein the two outer outlet openings enclose between themselves an angle of more than 50°.

* * * * *